US007093776B2

(12) United States Patent
Schneider

(10) Patent No.: US 7,093,776 B2
(45) Date of Patent: Aug. 22, 2006

(54) FUEL INJECTOR NOZZLE ATOMIZER HAVING INDIVIDUAL PASSAGES FOR INWARD DIRECTED ACCELERATED CROSS-FLOW

(75) Inventor: Michael Schneider, Victor, NY (US)

(73) Assignee: Delphi Technologies, INC, Troy, MI (US)

( * ) Notice: Subject to any disclaimer, the term of this patent is extended or adjusted under 35 U.S.C. 154(b) by 19 days.

(21) Appl. No.: 10/879,225

(22) Filed: Jun. 29, 2004

(65) Prior Publication Data

US 2005/0284965 A1 Dec. 29, 2005

(51) Int. Cl.
*F02M 61/00* (2006.01)

(52) U.S. Cl. ..... 239/533.12; 239/494; 239/497; 239/552; 239/556; 239/584; 239/585.1; 239/596

(58) Field of Classification Search ..... 239/468, 239/494, 497, 552, 533.12, 556, 558, 596, 239/585.1, 585.4, 585.5, 584
See application file for complete search history.

(56) References Cited

U.S. PATENT DOCUMENTS 5,685,491 A * 11/1997 Marks et al. ..... 239/533.12
5,899,390 A * 5/1999 Arndt et al. ..... 239/596
6,202,936 B1 3/2001 Frick
6,382,533 B1 5/2002 Mueller et al.
6,405,945 B1 6/2002 Dobrin
6,776,353 B1 * 8/2004 Moorthy et al. ..... 239/533.12
6,854,670 B1 * 2/2005 Sumisha et al. ..... 239/552
2003/0141385 A1 7/2003 Xu
2003/0155439 A1 8/2003 Winner

FOREIGN PATENT DOCUMENTS

EP 1 375 902 A2 1/2004

* cited by examiner

*Primary Examiner*—Steven J. Ganey
(74) *Attorney, Agent, or Firm*—Jimmy L. Funke

(57) ABSTRACT

A director plate system for a fuel injector for use in an internal combustion engine. The system includes flow channels for directing the fuel stream radially inward toward the discharge holes. The cross-sectional area of the flow channels diminish inwardly, in the direction of flow, to accelerate the fuel stream. A swirl element, for imparting tangential velocities or eddies to a plurality of individual fuel streams, can be combined with the radially inward directed flow channels. The director plate system may be provided as individual plates in a stack or may be combined with each other and/or the valve seat in a variety of plate configurations to simplify the number of components.

18 Claims, 4 Drawing Sheets

FUEL INJECTOR NOZZLE ATOMIZER HAVING INDIVIDUAL PASSAGES FOR INWARD DIRECTED ACCELERATED CROSS-FLOW

TECHNICAL FIELD

The present invention relates to internal combustion engines; more particularly, to fuel injectors for use in internal combustion engines; and most particularly, to a fuel injector having a multiple nozzle atomizer with individual passages for generating accelerated cross-flow in an inward direction.

BACKGROUND OF THE INVENTION

Fuel injectors for internal combustion engines are well known. Such devices are solenoid-driven valves employed for metering fuel in timed pulses from a high-pressure source such as a fuel rail into either the air intake manifold entrance ports for the individual engine cylinders ("port injection") or directly into the firing chambers ("direct injection"). In a direct injection system, to achieve high-quality combustion and high fuel efficiency, it is important that the injected fuel be vaporized virtually instantaneously as it exits the injector tip, preferably without striking the walls of the engine cylinder or the top of the piston. Thus, it is important that the fuel be precisely directed and highly atomized as it leaves the injector tip so that it may be mixed with the intake air in the optimum ratio for combustion.

For improved atomization, it is well known to divide the exiting fluid jet into a plurality of jets and to impart high turbulence to the jets by use of a director plate.

In a pressure-swirl atomization configuration, such a that disclosed in U.S. Pat. No. 6,202,936 and U.S. Pat. No. 6,382,533, a director plate is located upstream of the valve and seat. On the exterior periphery of the valve needle, diagonally running swirl channels, tangential to the seat orifice is provided in the director plate. The swirl channels empty into a swirl chamber from which the fuel is conveyed to the valve seat. When the valve is lifted from its seat, fuel flows past the valve and through the seat orifice. Because fuel pressure begins to drop above the valve seat as the fuel begins to flow through the swirl channels, and because of the swirl induced by the tangentially positioned swirl channels, the fuel is discharged from the injector in a hollow, conical sheet pattern. A drawback to this configuration is that other spray patterns, which may be more desirable in applications where precise placement of the fuel spray is needed, cannot be achieved.

In a multiple-hole plain orifice atomization configuration, a variety of spray patterns can be achieved. In such a configuration, the fuel director plate both assists in metering flow through the valve, by providing a fixed total flow area, and controls spray atomization and pattern. The director plate is disposed downstream of the valve head and seat. When the injector valve is retracted upon opening, fuel flows around the valve head and seat and then makes an abrupt turn, to flow in a radially outward direction toward multiple discharge holes. Typically, in a multiple hole director plate, the holes are arranged in a ring or other groupings to produce the desired pattern spray pattern. The axes of the holes may be inclined outwards or inwards from the axis of the fuel injector or may be tangentially inclined. The abrupt turn made by the fuel after passing by the seat increases the instability of the individual fuel streams exiting the director plate holes, thereby increasing the level of spray atomization. Moreover, the spray pattern is not limited to a conical sheet as in the case of pressure-swirl atomization configuration. As disclosed in U.S. Pat. No. 6,405,945 and U.S. 2003/0141385, the fuel director plate is located downstream of the valve head and seat, and the fuel is redirected radially outward through channels toward discharge holes on the bottom side of the director plate. The radial channels in these configurations are of a constant width and effective cross-sectional area. Thus, while various spray patterns can be achieved by varying the discharge hole pattern in the director plate, a drawback to this configuration is that the velocity of the fuel stream decreases as it flows radially outward through the director plate channels.

It is a principal object of the present invention to increase the level of atomization of fuel being ejected from the tip of a fuel injector in an internal combustion engine by accelerating the fuel stream by directing the stream radially inward through tapered flow channels to thereby accelerate the fuel stream.

SUMMARY OF THE INVENTION

Briefly described, a director plate system defining a multiple hole plain orifice atomizer for a fuel injector in accordance with the invention include flow channels for directing the fuel stream radially inward toward the discharge holes. The flow channels are tapered inwardly, in the direction of flow, to accelerate the fuel stream. In an alternate embodiment, a swirl element, for imparting tangential velocities or eddies to a plurality of individual fuel streams, is combined with the radially inward directed flow channels. The system in accordance with the invention is readily adaptable to provide various fuel spray patterns. The director plate system may be provided as individual plates in a stack or may be combined with each other and/or the valve seat in a variety of plate configurations to simplify the number of components.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
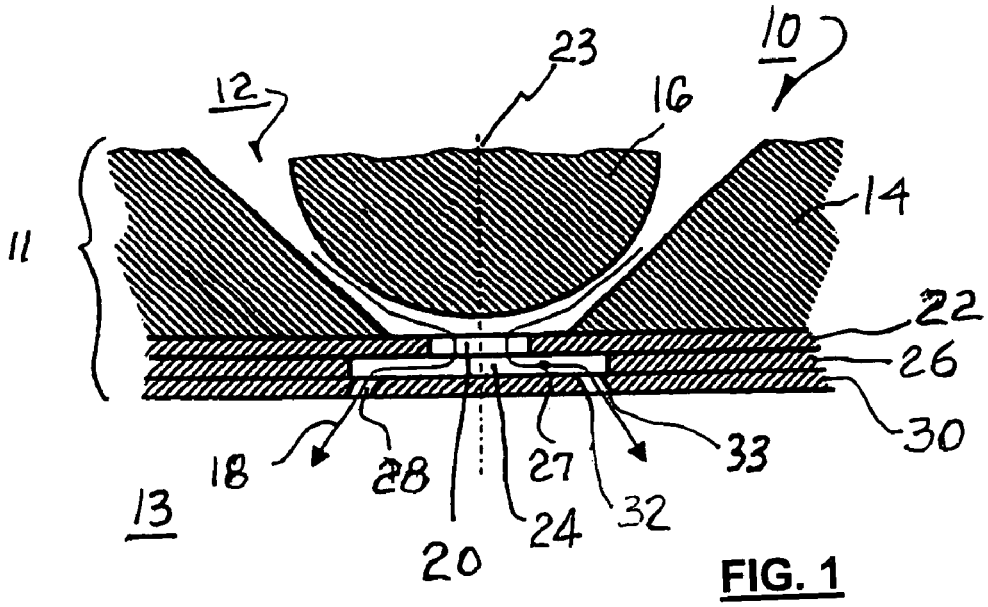
FIG. 1 (PRIOR ART)
FIG. 1 is an elevational cross-sectional view of the tip of a prior art fuel injector, showing radially outward cross-flow of fuel before entry into holes in a director plate.

Referring to FIG. 1, a prior art fuel injector 10 having a multiple-hole plain orifice atomization configuration is shown. Injector 10 having an injector tip 11 for use in injecting amounts of fuel into an internal combustion engine 13 in known fashion includes a fuel flow control valve 12 comprising a valve seat 14 and mating valve head 16. Head 16 is connected to a pintle (not shown) for axial reciprocation by an actuating solenoid (also not shown) in known fashion.

Following the downstream fuel flow direction as the valve in tip 11 opens, fuel flow is confined by valve seat 14 and head 16, then enters aperture 20 defined by cover plate 22. The fuel exits aperture 20 and is turned approximately 90° in an outward direction relative to axis 23 through chamber 24 defined by intermediate plate 26, and is discharged as jets 18 via a plurality of holes 28 formed in director plate 30. The holes typically are arranged in a circle about axis 23, each hole being axially inclined away from axis 23 in the flow direction, or inwardly inclined toward axis 23 (not shown), or inclined tangentially about the arranged circle (not shown), or any combination thereof. The direction 27 of fuel flow prior to entering director holes 28 is parallel to, and radially-outward of, the upper surface of director plate 30. Such radially-directed cross-flow of fuel, turning through approximately 90°, results in turbulence thereby providing spray atomization at the exits 32 of holes 28, exits 32 defining exit nozzles 33 for atomizing fuel.

Figure 2:
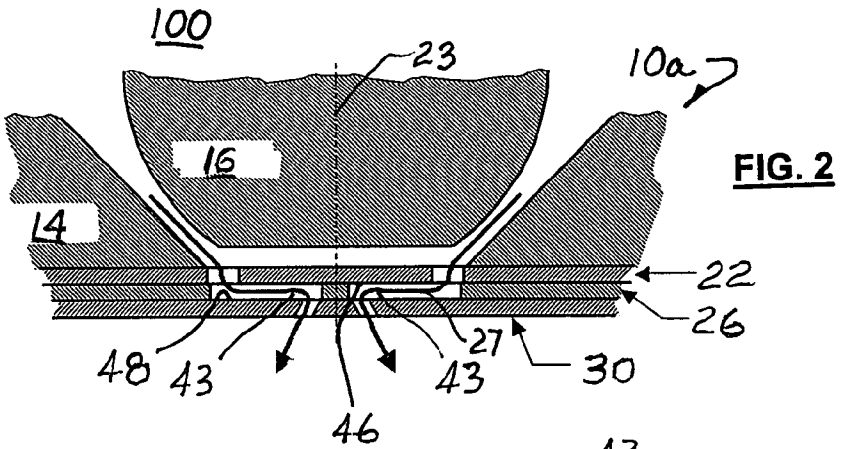
FIG. 2 is an elevational cross-sectional view of the tip of a first embodiment of a fuel injector in accordance with the invention, showing a combination of a cover plate, an intermediate plate, and a director plate.
Figure 4:
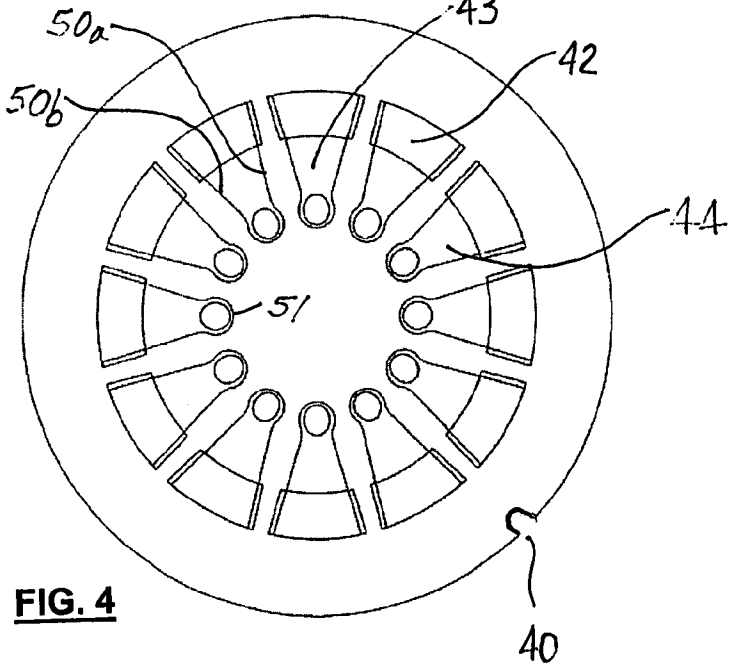
FIG. 4 is a schematic plan view showing overlain fuel flow passages of the cover plate, intermediate plate, and director plate shown in FIG. 3.
Figure 3:
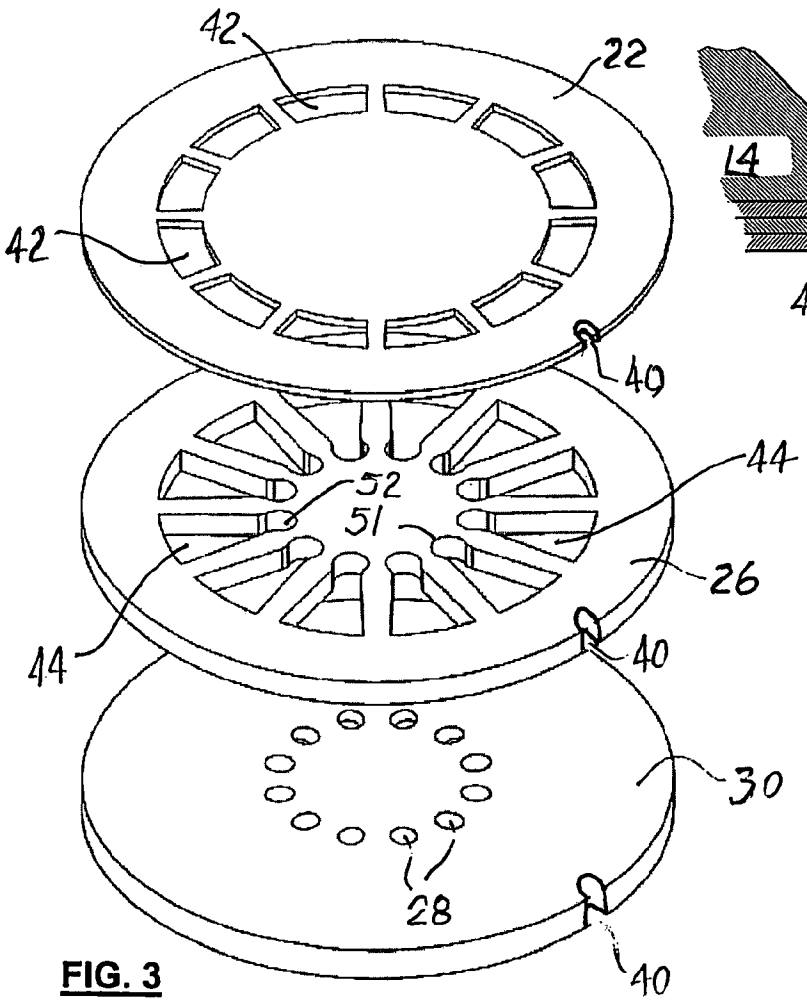
FIG. 3 is an isometric view of an exploded assembly of the cover plate, intermediate plate and director plate shown in FIG. 2.

Referring to FIGS. 2 through 4, a first embodiment 10*a* of a fuel injector in accordance with the invention comprises a fuel direction system 100 that includes a cover plate 22, an intermediate plate 26, and a director plate 30. The plates are rotationally aligned as known in the art, such as by individual notches 40, so that their respective openings, channels and holes are aligned as shown in FIG. 4. Cover plate 22 is provided with a plurality of openings 42 that align with the outer extremities of cross channels 44 in intermediate plate 26. Cover plate 22, in conjunction with cross channels 44, forms the upper wall 46 of flow passages 43 after assembly, the lower wall 48 being formed by director plate 30. The cross-sectional areas of flow passages 43 decrease inwardly relative to axis 23. As shown in FIGS. 3 and 4, each cross channel 44 has inwardly-converging sidewalls 50*a*, 50*b* such that the cross-sectional area of each flow passage 43 decreases with decreasing radius. Alternately, in accordance with the invention, the walls may be stepped and/or the bottom and/or top walls (not referenced) of the flow passages may be tapered or stepped so that the cross-sectional areas decrease with decreasing radius. Inner ends 51 of cross channels 44 are provided with channel openings 52 positioned an equal radial distance from axis 23. Channel openings 52 align with respective discharge holes 28 in director plate 30. The axes of holes 28 may be parallel to axis 23, inclined outwards or inwards from the axis of the fuel injector or may be tangentially inclined.

Figure 5:
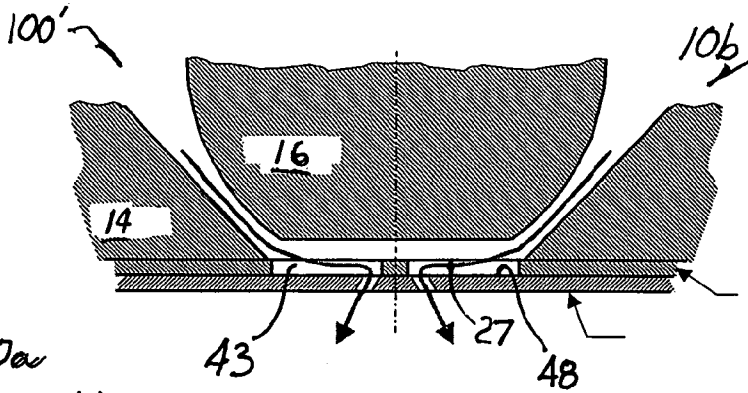
FIG. 5 is an elevational cross-sectional view of the tip of a second embodiment of a fuel injector in accordance with the invention, showing a combination a top plate, and a director plate.
Figure 7:
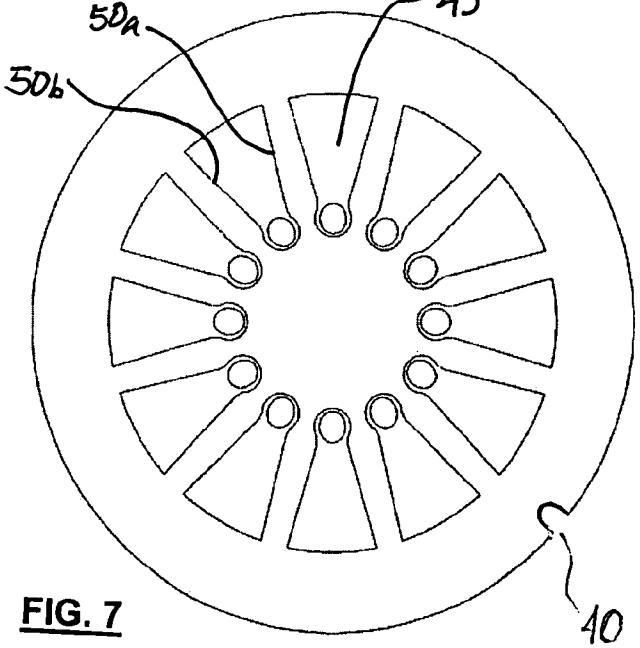
FIG. 7 is a schematic plan view showing overlain fuel flow passages of a top plate and director plate in as shown in FIG. 6.
Figure 6:
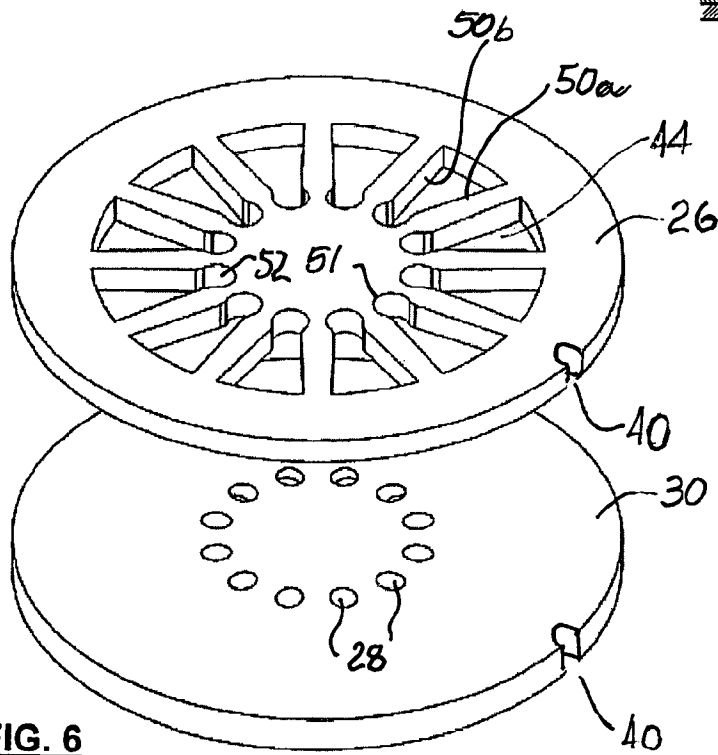
FIG. 6 is an isometric view of an exploded assembly of the top plate and director plate shown in FIG. 5.

Referring to FIGS. 5 through 7, a second embodiment 10*b* is shown wherein cover plate 22 of fuel injector 10*a* is eliminated. Fuel direction system 100' includes top plate 26' and director plate 30. Plates 26' and 30 are rotationally aligned such as by notches 40 so that their respective channels and holes are aligned as described above. Top plate 26' is provided with a plurality of cross channels 44. Each cross channel 44 has inwardly-converging sidewalls 50*a*, 50*b* such that the cross-sectional area of each flow passage 43 decreases with decreasing radius. Alternately, in accordance with the invention, the walls may be stepped and/or the bottom walls (not referenced) of the flow passages may be tapered or stepped so that the effective cross-sectional areas of the flow passages decrease with decreasing radius. The inner end 51 of each cross channel 44 is provided with a channel opening 52 that aligns with respective discharge hole 28 in director plate 30. In this embodiment, lower wall 48 of flow passage 43 is formed by director plate 30, after assembly. Since cover plate 22 is eliminated, flow passages 43 are open at the top.

Figure 9:
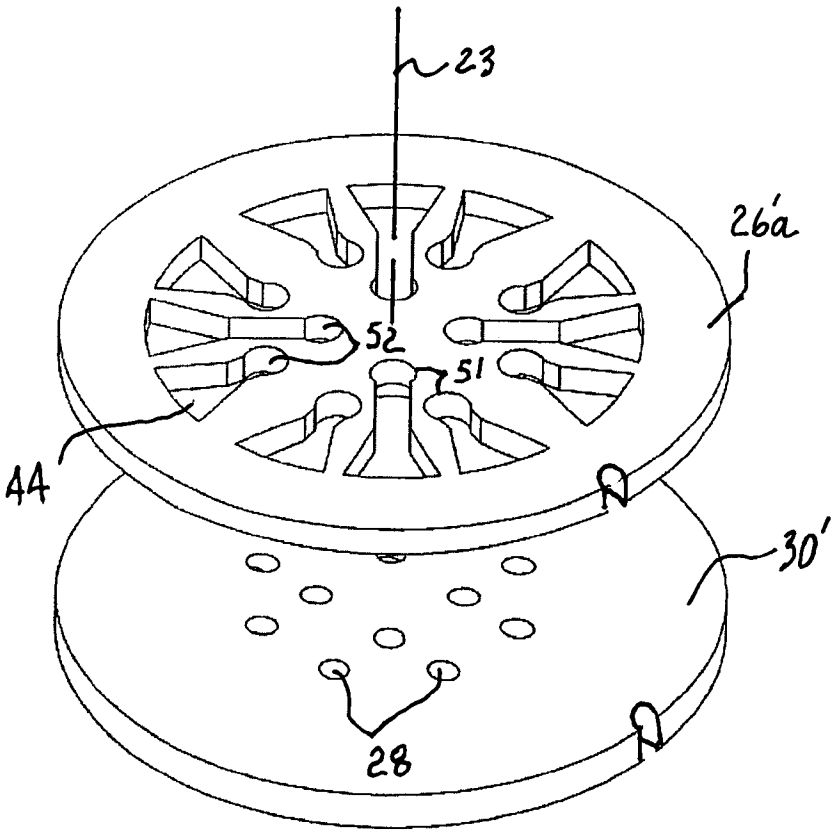
FIG. 9 is an isometric view of an exploded assembly similar to that shown in FIG. 6, but with a varied top plate and director plate, in accordance with the invention.
Figure 8:
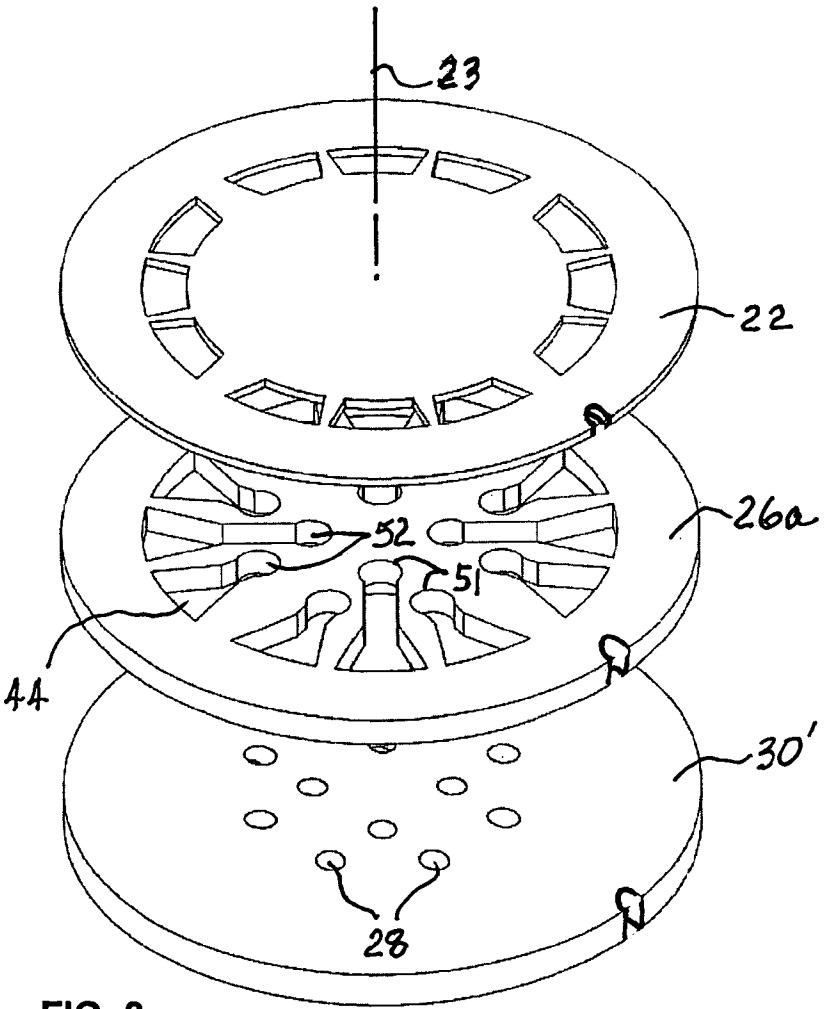
FIG. 8 is an isometric view of an exploded assembly similar to that shown in FIG. 3, but with a varied intermediate plate and director plate, in accordance with the invention.

Alternate embodiments 26*a* and 26'a of intermediate plate 26 and top plate 26' are shown in FIGS. 8 and 9, respectively. These embodiments permit the fuel spray pattern to be varied from that of the embodiments shown in FIGS. 5 through 7. In these embodiments, inner ends 51 of alternating cross channels 44 are provided with channel openings 52 positioned at varied radial distances from axis 23. In the embodiment shown, every third opening is positioned at a lesser radial distance from axis 23 than the other two channel openings. Of course, any pattern of varied radial distances may be used within the scope of the invention to achieve a desired fuel spray pattern. Channel openings 52 align with respective discharge holes 28 in director plate 30'.

Figure 10:
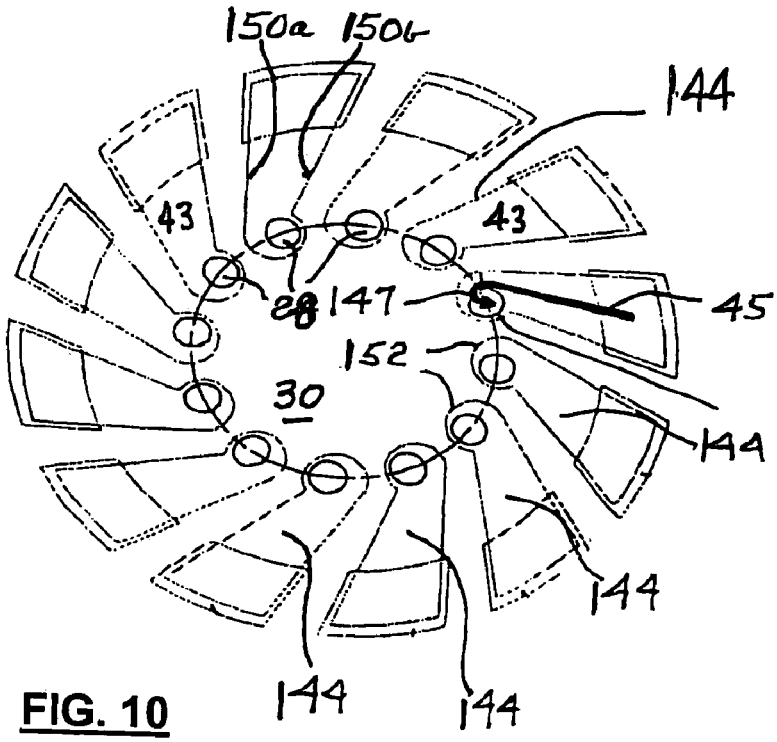
FIG. 10 is a schematic plan view showing overlain fuel flow passages of the cover plate, intermediate plate, and director plate similar to that shown in FIG. 4, but further including swirl elements.

A swirl feature may be added to the cross flow feature in accordance with the invention. As shown in FIG. 10, each sidewall 150*a*,150*b* of swirl channel 144 is non-radial such that a net rotational motion (counterclockwise in the example shown) is imparted to fuel 45 flowing radially inward through flow passages 43. In addition, each swirl channel 144 is provided with an asymmetric loop portion 152 superimposed on a hole 28 in director plate 30 to form an eddy 147 in the fuel such that each jet of fuel flowing through a hole 28 of flow passage 43 and being sprayed from plate 30 at an exit nozzle comprises its own individual vortex. In other words, the present invention provides a plurality of vortices from a plurality of holes in a director plate when combined with a swirl plate to form a plurality of flow channels. This vortical flow from each director plate hole provides improved atomization of the fuel charge in the engine manifold or cylinder.

Of course, the invention is not confined to a 12-hole/nozzle director plate as shown in the drawings but should be understood to encompass embodiments having different numbers of holes and flow channels.

Further, by careful design and fabrication, the total number of components may be reduced. For example, in the embodiment shown in FIGS. 2–4, 8 and 10, the cross channels 44,144, may be formed directly in the underside of cover plate 22 or in the upper side of director plate 30. For another example, valve seat 14 and cover plate 22 may be combined.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A director plate system for a fuel injector, said system comprising:

a) a flow channel plate having a plurality of flow channels extending non-axially of said system wherein a cross-sectional area of at least one flow channel decreases with a decreasing radius relative to a longitudinal axis of said system and in a direction of a flow of fuel through said at least one flow channel; and b) a director plate having a plurality of holes;

wherein at least one of said plurality of flow channels, and at least one of said plurality of holes are in fluid communication with each other to form at least one flow passage.

2. A system in accordance with claim 1 wherein sidewalls of at least one of said plurality of flow channels are inwardly converging relative to said axis.

3. A system in accordance with claim 1 further including a top plate having at least one opening wherein at least one of said at least one opening, at least one of said plurality of flow channels, and at least one of said plurality of holes are in fluid communication with each other to form at least one flow passage.

4. A system in accordance with claim 3 wherein sidewalls of at least one of said plurality of flow channels are inwardly converging relative to said axis.

5. A system in accordance with claim 3 wherein said top plate is integral with a valve seat in said fuel injector.

6. A system in accordance with claim 3 wherein said top plate is integral with said flow channel plate.

7. A system in accordance with claim 3 wherein any two or more of said top plate, said flow channel plate, said director plate and a valve seat are integral with each other.

8. A system in accordance with claim 1 wherein said plurality of flow channels are disposed in a plane orthogonal to a longitudinal axis of said fuel injector.

9. A system in accordance with claim 8 wherein said plurality of flow channels are non-radial in said plane.

10. A system in accordance with claim 9 wherein at least one of said plurality of flow channels includes an asymmetrical loop disposed at an end of said at least one of said plurality of flow channels.

11. A system in accordance with claim 10 wherein said loop is disposed at a radially inner end of said at least one of said plurality of flow channels.

12. A system in accordance with claim 1 wherein said plurality of holes define a plurality of atomizing nozzles.

13. A system in accordance with claim 1 wherein said flow channel plate is integral with said director plate.

14. A system in accordance with claim 1 wherein any two of said flow channel plate, said director plate and a valve seat are integral with each other.

15. A fuel injector, comprising:

a) a flow channel plate having a plurality of flow channels extending non-axially of said fuel injector wherein a cross-sectional area of at least one flow channel decreases with a decreasing radius relative to a longitudinal axis of said fuel injector and in a direction of a flow of fuel through said at least one flow channel; and b) a director plate having a plurality of holes;

wherein at least one of said plurality of flow channels, and at least one of said plurality of holes are in fluid communication with each other to form at least one flow passage.

16. A fuel injector according to claim 15 wherein said fuel flows inwardly through said plurality of flow channels.

17. A director plate system for a fuel injector, said system comprising:

a) a flow channel plate having a plurality of flow channels extending non-axially of said system wherein a cross-sectional area of at least one flow channel decreases with a decreasing radius relative to a longitudinal axis of said system;

b) a director plate having a plurality of holes; and c) a top plate having at least one opening wherein at least one of said at least one opening, at least one of said plurality of flow channels, and at least one of said plurality of holes are in fluid communication with each other to form at least one flow passage, wherein said top plate is integral with said flow channel plate.

18. A director plate system for a fuel injector, said system comprising:

a) a flow channel plate having a plurality of flow channels extending non-axially of said system wherein a cross-sectional area of at least one flow channel decreases with a decreasing radius relative to a longitudinal axis of said system, said plurality of flow channels are disposed non-radial in a plane orthogonal to a longitudinal axis of said fuel injector, at least one of said plurality of flow channels including an asymmetrical loop disposed at a radially inner end of said at least one of said plurality of flow channels; and b) a director plate having a plurality of holes;

wherein at least one of said plurality of flow channels, and at least one of said plurality of holes are in fluid communication with each other to form at least one flow passage.

* * * * *